US010223967B1

(12) United States Patent
Kuang et al.

(10) Patent No.: US 10,223,967 B1
(45) Date of Patent: Mar. 5, 2019

(54) OLED PIXEL DRIVING CIRCUIT AND PIXEL DRIVING METHOD

(71) Applicant: Shenzhen China Star Optoelectronics Semiconductor Display Technology Co., Ltd., Shenzhen (CN)

(72) Inventors: Jimu Kuang, Shenzhen (CN); Yichien Wen, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/735,200

(22) PCT Filed: Nov. 27, 2017

(86) PCT No.: PCT/CN2017/113036

§ 371 (c)(1),
(2) Date: Dec. 11, 2017

(30) Foreign Application Priority Data

Nov. 27, 2017 (CN) ..... 2017 1 0787445

(51) Int. Cl.
*G09G 3/3233* (2016.01)

(52) U.S. Cl.
CPC ... *G09G 3/3233* (2013.01); *G09G 2300/0819* (2013.01); *G09G 2310/08* (2013.01); *G09G 2320/0233* (2013.01); *G09G 2320/045* (2013.01)

(58) Field of Classification Search
None
See application file for complete search history.

(56) References Cited

U.S. PATENT DOCUMENTS

2011/0069058 A1* 3/2011 Chung ..... G09G 3/3233 345/212
2011/0115764 A1* 5/2011 Chung ..... G09G 3/3233 345/205
2012/0139957 A1* 6/2012 Choi ..... G09G 3/3233 345/690
2015/0029079 A1 1/2015 Miyazawa et al.
(Continued)

FOREIGN PATENT DOCUMENTS

CN 101986378 A 3/2011
CN 102982767 A 3/2013
(Continued)

*Primary Examiner* — Michael A Faragalla
*Assistant Examiner* — Benjamin Morales
(74) *Attorney, Agent, or Firm* — Leong C. Lei

(57) ABSTRACT

The invention provides an OLED pixel driving circuit and pixel driving method. The OLED pixel driving circuit adopts a 6T2C structure, comprising: first to sixth TFTs (T1, T2, T3, T4, T5, T6), a first capacitor (C1), a second capacitor (c2), and an OLED (D); the (n−1)th first scan signal (Scan1(*n*−1)), n-th first scan signal (Scan1(*n*)), n-th second scan signal (Scan2(*n*)), n-th third scan signal (Scan3(*n*)), n-th fourth scan signal (Scan4(*n*)) and the data signal (Data) are combined w to correspond to a reset stage, a threshold voltage storage stage, a data writing stage, a capacitor cascading stage, and a display lighting stage respectively so that the current flowing through the OLED is independent of the threshold voltage of driving TFT.

9 Claims, 8 Drawing Sheets

(56) References Cited

U.S. PATENT DOCUMENTS

| | | | | |
|---|---|---|---|---|
| 2015/0294624 | A1* | 10/2015 | Liu | G09G 3/3233 345/690 |
| 2015/0302798 | A1* | 10/2015 | Tan | G09G 3/3233 345/698 |
| 2016/0307497 | A1* | 10/2016 | Nie | G09G 3/3233 |
| 2016/0307500 | A1* | 10/2016 | Han | G09G 3/3233 |
| 2017/0110048 | A1* | 4/2017 | Kim | G09G 3/325 |
| 2017/0236469 | A1* | 8/2017 | Wang | G09G 3/3233 345/212 |

FOREIGN PATENT DOCUMENTS

| | | | |
|---|---|---|---|
| CN | 103021338 | A | 4/2013 |
| CN | 105096817 | A | 11/2015 |
| CN | 105280136 | A | 1/2016 |
| CN | 105895022 | A | 8/2016 |

* cited by examiner

OLED PIXEL DRIVING CIRCUIT AND PIXEL DRIVING METHOD

BACKGROUND OF THE INVENTION

1. Field of the Invention

The present invention relates to the field of display techniques, and in particular to an OLED pixel driving circuit and pixel driving method.

2. The Related Arts

The organic light emitting diode (OLED) panel provides the advantages of active-luminescent, low driving voltage, high emission efficiency, quick response time, high resolution and contrast, near 180° viewing angle, wide operation temperature range, and capability to realize flexible display and large-area full-color display, and is heralded as the most promising display technology.

The OLED panel comprises a plurality of pixels arranged in an array, with each pixel driven by an OLED pixel driving circuit. The OLED is an electroluminescent device driven by electric current; that is, when a current flows through OLED, the OLED illuminates, and the brightness is determined by the current flowing through the OLED. The majority of known integrated circuit (IC) only transmits the voltage signal, and the pixel driving circuit of the OLED display must accomplish the task of translating the voltage signal into a current signal. The conventional pixel driving circuit usually uses a 2T1C structure, i.e., two thin film transistors (TFT) and a capacitor, to translate the voltage into current.

As shown in FIG. 1, a conventional 2T1C pixel driving circuit for driving OLED device comprises: a first TFT T10, second TFT T20, and a capacitor C10. The first TFT T10 is a switching TFT, the second TFT T20 is a driving TFT, and the capacitor T10 is a storage capacitor. Specifically, the first TFT T10 has a gate connected to receive a scan signal Scan(n) corresponding to the row to which the pixel driving circuit belonging, a drain connected to receive a data signal Data, and a source electrically connected to a gate of the second TFT T20 and to one end of the capacitor C10. The second TFT T20 has a drain connected to receive a voltage VDD of a power source, and a source connected to receive an anode of the OLED D10; the OLED D10 has a cathode connected to receive a common ground voltage VSS; the capacitor C10 has one end electrically connected to the drain of the second TFT T20, and the other end electrically connected to the source of the second TFT T20. When the OLED displays, the scan signal Scan(n) controls the first TFT T10 to be turned on, the data signal Data passes through the first TFT T10 and enters the gate of the second TFT T20 and the capacitor C10. Then, the first TFT T10 is cut off. Because of the storage of the capacitor C10, the gate voltage of the second TFT T20 stays at the data signal voltage level so that the second TFT T20 stays turned on. The driving current flows through the second TFT T20 to enter the OLED D10 and drives the OLED D10 to emit light.

According to the equation calculating the current flowing through the driving TFT and the OLED:

$$I_{OLED}=K\times(Vgs-Vth)^2;$$

Wherein K is the intrinsic conductive factor, of the driving TFT, Vgs is the voltage difference across the gate and the source of the driving TFT, and Vth is the threshold voltage of the driving TFT.

As seen, the size of $I_{OLED}$ is related to the threshold voltage Vth of the driving TFT.

Because the non-uniformity of the TFT fabrication process, the threshold voltages of the driving TFTs of all pixels in the OLED display device will be inconsistent. Moreover, due to long operation time, the ageing of the driving TFT will cause voltage drift of the threshold voltage of the driving TFTs, leading to display unevenness and resulting in affecting the brightness of the OLED. The above conventional 2T1C pixel driving circuit does not compensate the threshold voltage Vth of the driving TFT, and therefore, the OLED panel will suffer the problem of uneven brightness.

SUMMARY OF THE INVENTION

The object of the present invention is to provide an OLED pixel driving circuit, able to compensate the threshold voltage of driving TFT, eliminate the impact of the threshold voltage of the driving TFT on the OLED, and achieve uniform display and improve image quality.

Another object of the present invention is to provide an OLED pixel driving method, able to compensate the threshold voltage of driving TFT, eliminate the impact of the threshold voltage of the driving TFT on the OLED, and achieve uniform display and improve image quality.

To achieve the above object, the present invention provides an OLED pixel driving circuit, comprising: a first thin film transistor (TFT), a second TFT, a third TFT, a fourth TFT, a fifth TFT, a sixth TFT, a first capacitor, a second capacitor, and an OLED;

the first TFT having a gate connected to a first node, a drain connected to a positive voltage power source, and a source connected to a drain of the third TFT; the first TFT being a driving TFT;

for a positive integer n>1, the second TFT having a gate connected to an n-th third scan signal corresponding to a row to which the pixel driving circuit belonging, a source connected to a data signal, and a drain connected to the first node;

the third TFT having a gate connected to an n-th second scan signal corresponding to a row to which the pixel driving circuit belonging, a drain connected to the source of the first TFT, and a source connected to a third node;

the fourth TFT having a gate connected to an (n−1)-th first scan signal corresponding to a row above the row to which the pixel driving circuit belonging, a source connected to a second node and one end of the second capacitor, and a drain connected to the third node and the other end of the second capacitor;

the fifth TFT having a gate connected to an n-th first scan signal corresponding to a row to which the pixel driving circuit belonging, a source connected to the second node, and a drain connected to a negative voltage power source;

the sixth TFT having a gate connected to an n-th fourth scan signal corresponding to a row to which the pixel driving circuit belonging, a source connected to the third node, and a drain connected to the negative voltage power source;

the first capacitor having one end connected to the first node and the other end connected to the second node;

the second capacitor having one end connected to the second node and the other end connected to the third node;

the OLED having an anode connected to the third node, and a cathode connected to the negative voltage power source.

According to a preferred embodiment of the present invention, the first TFT, the second TFT, the third TFT, the fourth TFT, the fifth TFT, and the sixth TFT are all low temperature polysilicon (LTPS) TFTs, oxide semiconductor TFTs, or amorphous silicon (a-Si) TFTs.

According to a preferred embodiment of the present invention, the (n−1)-th first scan signal, the n-th first scan signal, the n-th second scan signal, the n-th third scan signal, the n-th fourth scan signal, and the data signal are all provided by an external timing controller.

According to a preferred embodiment of the present invention, the (n−1)-th first scan signal, the n-th first scan signal, the n-th second scan signal, the n-th third scan signal, the n-th fourth scan signal, and the data signal are combined to correspond to a reset stage, a threshold voltage storage stage, a data writing stage, a capacitor cascading stage, and a display lighting stage, respectively.

According to a preferred embodiment of the present invention, in the reset stage, the (n−1)-th first scan signal is at high voltage, the n-th first scan signal is at low voltage, the n-th second scan signal is at low voltage, the n-th third scan signal is at low voltage, the n-th fourth scan signal is at high voltage, and the data signal is at low voltage;

in the threshold voltage storage stage, the (n−1)-th first scan signal is at low voltage, the n-th first scan signal is at high voltage, the n-th second scan signal is at high voltage, the n-th third scan signal is at high voltage, the n-th fourth scan signal is at low voltage, and the data signal is at a first high voltage; in the data writing stage, the (n−1)-th first scan signal is at low voltage, the n-th first scan signal is at high voltage, the n-th second scan signal is at low voltage, the n-th third scan signal is at high voltage, the n-th fourth scan signal is at low voltage, and the data signal is at a second high voltage higher than the first high voltage; in the capacitor cascading stage, the (n−1)-th first scan signal is at low voltage, the n-th first scan signal is at low voltage, the n-th second scan signal is at low voltage, the n-th third scan signal is at low voltage, the n-th fourth scan signal is at high voltage, and the data signal is at low voltage; in the display lighting stage, the (n−1)-th first scan signal is at low voltage, the n-th first scan signal is at low voltage, the n-th second scan signal is at high voltage, the n-th third scan signal is at low voltage, the n-th fourth scan signal is at low voltage, and the data signal is at low voltage.

The present invention also provides an OLED pixel driving method, which comprises the following steps:

Step S1: providing an OLED pixel driving circuit;

the OLED pixel driving circuit, comprising: a first thin film transistor (TFT), a second TFT, a third TFT, a fourth TFT, a fifth TFT, a sixth TFT, a first capacitor, a second capacitor, and an OLED;

the first TFT having a gate connected to a first node, a drain connected to a positive voltage power source, and a source connected to a drain of the third TFT; the first TFT being a driving TFT;

for a positive integer n>1, the second TFT having a gate connected to an n-th third scan signal corresponding to a row to which the pixel driving circuit belonging, a source connected to a data signal, and a drain connected to the first node;

the third TFT having a gate connected to an n-th second scan signal corresponding to a row to which the pixel driving circuit belonging, a drain connected to the source of the first TFT, and a source connected to a third node;

the fourth TFT having a gate connected to an (n−1)-th first scan signal corresponding to a row above the row to which the pixel driving circuit belonging, a source connected to a second node and one end of the second capacitor, and a drain connected to the third node and the other end of the second capacitor;

the fifth TFT having a gate connected to an n-th first scan signal corresponding to a row to which the pixel driving circuit belonging, a source connected to the second node, and a drain connected to a negative voltage power source;

the sixth TFT having a gate connected to an n-th fourth scan signal corresponding to a row to which the pixel driving circuit belonging, a source connected to the third node, and a drain connected to the negative voltage power source;

the first capacitor having one end connected to the first node and the other end connected to the second node;

the second capacitor having one end connected to the second node and the other end connected to the third node;

the OLED having an anode connected to the third node, and a cathode connected to the negative voltage power source;

Step S2: entering reset stage;

the (n−1)-th first scan signal providing high voltage, the n-th first scan signal providing low voltage, the n-th second scan signal providing low voltage, the n-th third scan signal providing low voltage, the n-th fourth scan signal providing high voltage, and the data signal providing low voltage; the second TFT, the third TFT, and the fifth TFT all being cut-off; the fourth TFT turned on to perform reset on the second capacitor; the sixth TFT turned on to perform reset on the OLED;

Step S3: entering threshold voltage storage stage;

the (n−1)-th first scan signal becoming low voltage, the n-th first scan signal becoming high voltage, the n-th second scan signal becoming high voltage, the n-th third scan signal becoming high voltage, the n-th fourth scan signal becoming low voltage, and the data signal becoming a first high voltage; the fourth TFT and the sixth TFT being cut-off; the second TFT, the first TFT, the third TFT, and the fifth TFT all being turned on, and the data signal providing the first high voltage to the first node and charging the second capacitor until voltage difference $V_{BA}$ between the third node and the second node reaching $V_{BA}=V\mathbf{1}_D-V_{th}$, wherein $V\mathbf{1}_D$ being the first high voltage provided by the data signal, $V_{th}$ being threshold voltage of the first TFT;

Step S4: entering data writing stage;

the (n−1)-th first scan signal maintaining at low voltage, the n-th first scan signal maintaining at high voltage, the n-th second scan signal becoming low voltage, the n-th third scan signal maintaining at high voltage, the n-th fourth scan signal maintaining at low voltage; the third TFT, the fourth TFT, and the sixth TFT being cut-off; the second TFT, the first TFT, and the fifth TFT being turned on, and the data signal providing to the first node a second high voltage higher than the first high voltage and charging the first capacitor so that voltage difference $V_{GA}$ between the first node and the second node equal to $V_{GA}=V\mathbf{2}_D$, wherein $V\mathbf{2}_D$ being the second high voltage provided by the data signal;

Step S5: entering capacitor cascading stage;

the (n−1)-th first scan signal maintaining at low voltage, the n-th first scan signal becoming low voltage, the n-th second scan signal maintaining at low voltage, the n-th third scan signal becoming low voltage, the n-th fourth scan signal becoming high voltage, and the data signal becoming low voltage; the second TFT, the third TFT, the fourth TFT, and the fifth TFT being cut-off; the sixth TFT being turned on, the first capacitor and the second capacitor being cascaded so that voltage difference $V_{GB}$ between the first node and the third node becoming $V_{GB}=V\mathbf{2}_D-V\mathbf{1}_D+V_{th}$;

Step S6: entering display lighting stage;

the (n−1)-th first scan signal maintaining at low voltage, the n-th first scan signal maintaining at low voltage, the n-th second scan signal becoming high voltage, the n-th third scan signal maintaining at low voltage, the n-th fourth scan signal becoming low voltage, and the data signal providing low voltage; the second TFT, the fourth TFT, the fifth TFT, and the sixth TFT being cut-off, the first TFT and the third TFT being turned on, the OLED emitting light, and current flowing through the OLED being independent of the threshold voltage of the driving TFT.

According to a preferred embodiment of the present invention, the first TFT, the second TFT, the third TFT, the fourth TFT, the fifth TFT, and the sixth TFT are all low temperature polysilicon (LTPS) TFTs, oxide semiconductor TFTs, or amorphous silicon (a-Si) TFTs.

According to a preferred embodiment of the present invention, the (n−1)-th first scan signal, the n-th first scan signal, the n-th second scan signal, the n-th third scan signal, the n-th fourth scan signal, and the data signal are all provided by an external timing controller.

The present invention further provides an OLED pixel driving circuit, comprising: a first thin film transistor (TFT), a second TFT, a third TFT, a fourth TFT, a fifth TFT, a sixth TFT, a first capacitor, a second capacitor, and an OLED;

the first TFT having a gate connected to a first node, a drain connected to a positive voltage power source, and a source connected to a drain of the third TFT; the first TFT being a driving TFT;

for a positive integer n>1, the second TFT having a gate connected to an n-th third scan signal corresponding to a row to which the pixel driving circuit belonging, a source connected to a data signal, and a drain connected to the first node;

the third TFT having a gate connected to an n-th second scan signal corresponding to a row to which the pixel driving circuit belonging, a drain connected to the source of the first TFT, and a source connected to a third node;

the fourth TFT having a gate connected to an (n−1)-th first scan signal corresponding to a row above the row to which the pixel driving circuit belonging, a source connected to a second node and one end of the second capacitor, and a drain connected to the third node and the other end of the second capacitor;

the fifth TFT having a gate connected to an n-th first scan signal corresponding to a row to which the pixel driving circuit belonging, a source connected to the second node, and a drain connected to a negative voltage power source;

the sixth TFT having a gate connected to an n-th fourth scan signal corresponding to a row to which the pixel driving circuit belonging, a source connected to the third node, and a drain connected to the negative voltage power source;

the first capacitor having one end connected to the first node and the other end connected to the second node;

the second capacitor having one end connected to the second node and the other end connected to the third node;

the OLED having an anode connected to the third node, and a cathode connected to the negative voltage power source;

wherein the first TFT, the second TFT, the third TFT, the fourth TFT, the fifth TFT, and the sixth TFT being all low temperature polysilicon (LTPS) TFTs, oxide semiconductor TFTs, or amorphous silicon (a-Si) TFTs;

wherein the (n−1)-th first scan signal, the n-th first scan signal, the n-th second scan signal, the n-th third scan signal, the n-th fourth scan signal, and the data signal being all provided by an external timing controller;

wherein the (n−1)-th first scan signal, the n-th first scan signal, the n-th second scan signal, the n-th third scan signal, the n-th fourth scan signal, and the data signal being combined to correspond to a reset stage, a threshold voltage storage stage, a data writing stage, a capacitor cascading stage, and a display lighting stage, respectively;

wherein in the reset stage, the (n−1)-th first scan signal being at high voltage, the n-th first scan signal being at low voltage, the n-th second scan signal being at low voltage, the n-th third scan signal being at low voltage, the n-th fourth scan signal being at high voltage, and the data signal being at low voltage;

in the threshold voltage storage stage, the (n−1)-th first scan signal being at low voltage, the n-th first scan signal being at high voltage, the n-th second scan signal being at high voltage, the n-th third scan signal being s at high voltage, the n-th fourth scan signal being at low voltage, and the data signal being at a first high voltage;

in the data writing stage, the (n−1)-th first scan signal being at low voltage, the n-th first scan signal being at high voltage, the n-th second scan signal being at low voltage, the n-th third scan signal being at high voltage, the n-th fourth scan signal being at low voltage, and the data signal being at a second high voltage higher than the first high voltage;

in the capacitor cascading stage, the (n−1)-th first scan signal being at low voltage, the n-th first scan signal being at low voltage, the n-th second scan signal being at low voltage, the n-th third scan signal being at low voltage, the n-th fourth scan signal being at high voltage, and the data signal being at low voltage;

in the display lighting stage, the (n−1)-th first scan signal being at low voltage, the n-th first scan signal being at low voltage, the n-th second scan signal being at high voltage, the n-th third scan signal being at low voltage, the n-th fourth scan signal being at low voltage, and the data signal being at low voltage.

The present invention provides the following advantages. The present invention provides an OLED pixel driving circuit and pixel driving method, adopting a 6T2C structure driving circuit, an (n−1)th first scan signal, an n-th first scan signal, an n-th second scan signal, an n-th third scan signal and an n-th fourth scan signal are combined with the data signal to correspond to a reset stage, a threshold voltage storage stage, a data writing stage, a capacitor cascading stage, and a display lighting stage respectively so that the current flowing through the OLED is independent of the threshold voltage of driving TFT, i.e., the threshold voltage of the driving TFT is compensated and the impact of the threshold voltage of driving TFT on the OLED is eliminated so as to make the display brightness of the OLED panel more uniform and improve the display quality of the OLED panel.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technique means and effect of the present invention, the following uses preferred embodiments and drawings for detailed description.

Figure 1:
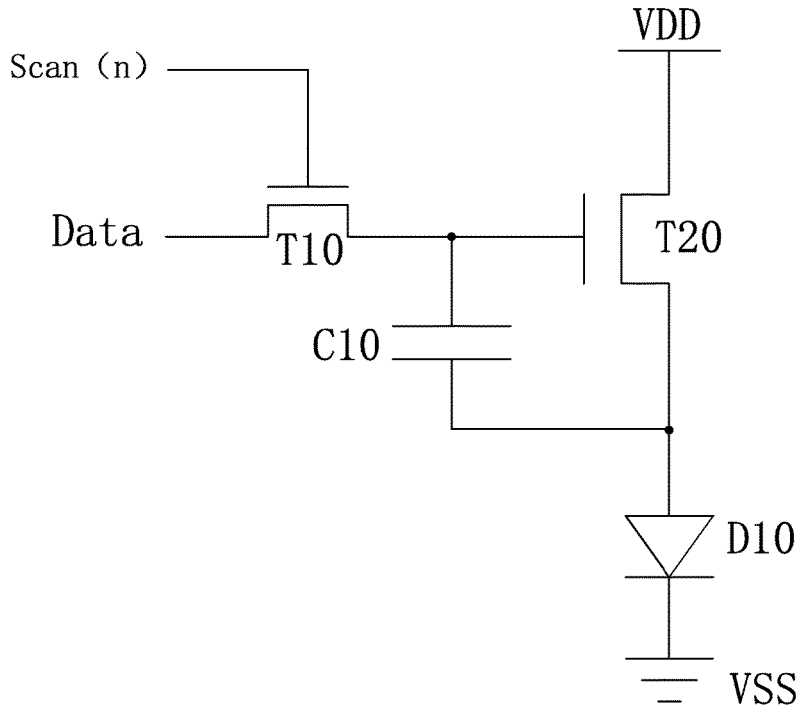
FIG. 1 is a schematic view showing a conventional OLED pixel driving circuit with 2T1C structure.
Figure 2:
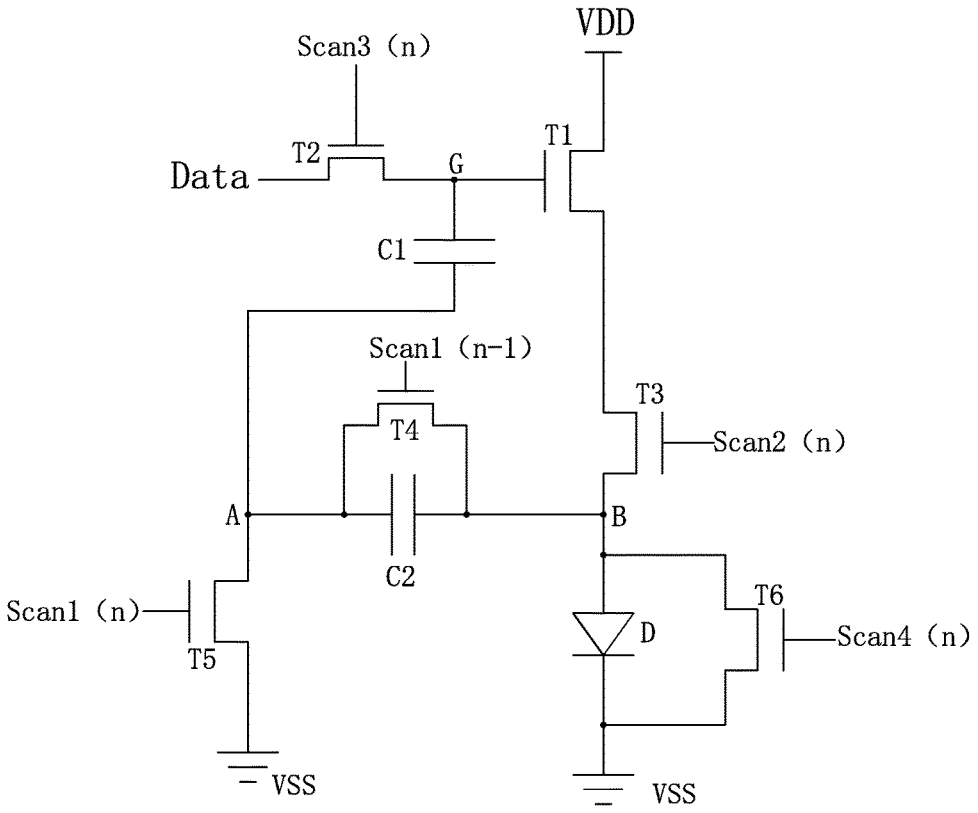
FIG. 2 is a schematic view showing an OLED pixel driving circuit provided by an embodiment of the present invention.
Figure 3:
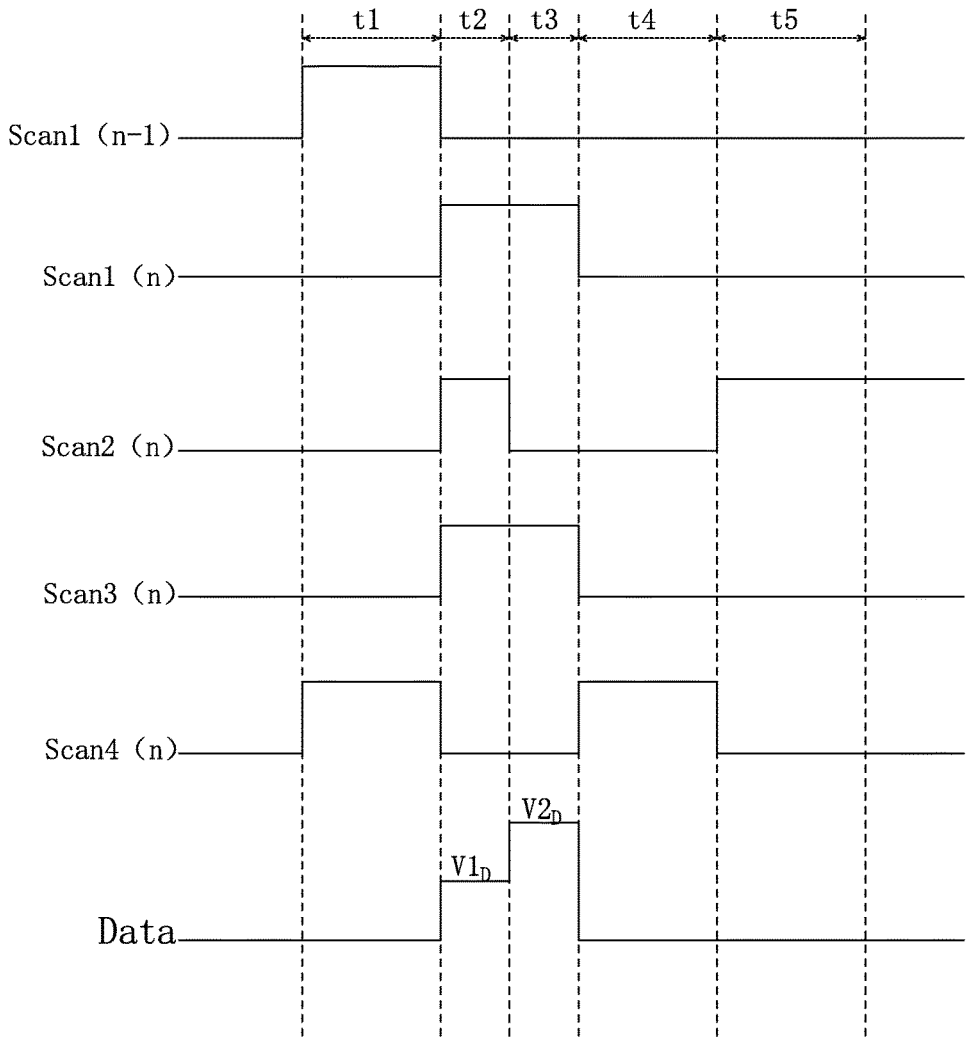
FIG. 3 is a schematic view showing the signal timing sequence for the OLED pixel driving circuit provided by an embodiment of the present invention.

The present invention provides an OLED pixel driving circuit, applicable to an OLED panel, the OLED panel comprising a plurality of pixels, with each pixel driven by an OLED pixel driving circuit. Refer to FIG. 2 and FIG. 3. The OLED pixel driving circuit of the present invention is of a 6T2C structure, comprising: a first thin film transistor (TFT) T1, a second TFT T2, a third TFT T3, a fourth TFT T4, a fifth TFT T5, a sixth TFT T6, a first capacitor C1, a second capacitor C2, and an OLED D; wherein the first TFT T1 being used as a driving TFT.

The first TFT T1 has a gate connected to a first node G, a drain connected to a positive voltage power source VDD, and a source connected to a drain of the third TFT T3; the first TFT T1 is a driving TFT.

For a positive integer n>1, the second TFT T2 has a gate connected to an n-th third scan signal Scan3(3) corresponding to a row to which the OLED pixel driving circuit belonging, a source connected to a data signal Data, and a drain connected to the first node G.

The third TFT T3 has a gate connected to an n-th second scan signal Scan2(*n*) corresponding to a row to which the OLED pixel driving circuit belonging, a drain connected to the source of the first TFT T1, and a source connected to a third node B.

The fourth TFT T2 has a gate connected to an (n−1)-th first scan signal Scan1(*n*−1) corresponding to a row above the row to which the OLED pixel driving circuit belonging, a source connected to a second node A and one end of the second capacitor C2, and a drain connected to the third node B and the other end of the second capacitor C2.

The fifth TFT T5 has a gate connected to an n-th first scan signal Scan1(*n*) corresponding to a row to which the OLED pixel driving circuit belonging, a source connected to the second node A, and a drain connected to a negative voltage power source VSS.

The sixth TFT T6 has a gate connected to an n-th fourth scan signal Scan4(*n*) corresponding to a row to which the OLED pixel driving circuit belonging, a source connected to the third node B, and a drain connected to the negative voltage power source VSS.

The first capacitor C1 has one end connected to the first node G and the other end connected to the second node A.

The second capacitor C2 ahs one end connected to the second node A and the other end connected to the third node B.

The OLED D has an anode connected to the third node B, and a cathode connected to the negative voltage power source VSS.

Specifically, the first TFT T1, the second TFT T2, the third TFT T3, the fourth TFT T4, the fifth TFT T5, and the sixth TFT T6 are all low temperature polysilicon (LTPS) TFTs, oxide semiconductor TFTs, or amorphous silicon (a-Si) TFTs.

The (n−1)-th first scan signal Scan1(*n*−1), the n-th first scan signal Scan1(*n*), the n-th second scan signal Scan2(*n*), the n-th third scan signal Scan3(*n*), the n-th fourth scan signal Scan4(*n*), and the data signal Data are all provided by an external timing controller. As shown in FIG. 3, the (n−1)-th first scan signal Scan1(*n*−1), the n-th first scan signal Scan1(*n*), the n-th second scan signal Scan2(*n*), the n-th third scan signal Scan3(*n*), the n-th fourth scan signal Scan4(*n*), and the data signal Data are combined to correspond to a reset stage t1, a threshold voltage storage stage t2, a data writing stage t3, a capacitor cascading stage t4, and a display lighting stage t5, respectively.

Figure 4:
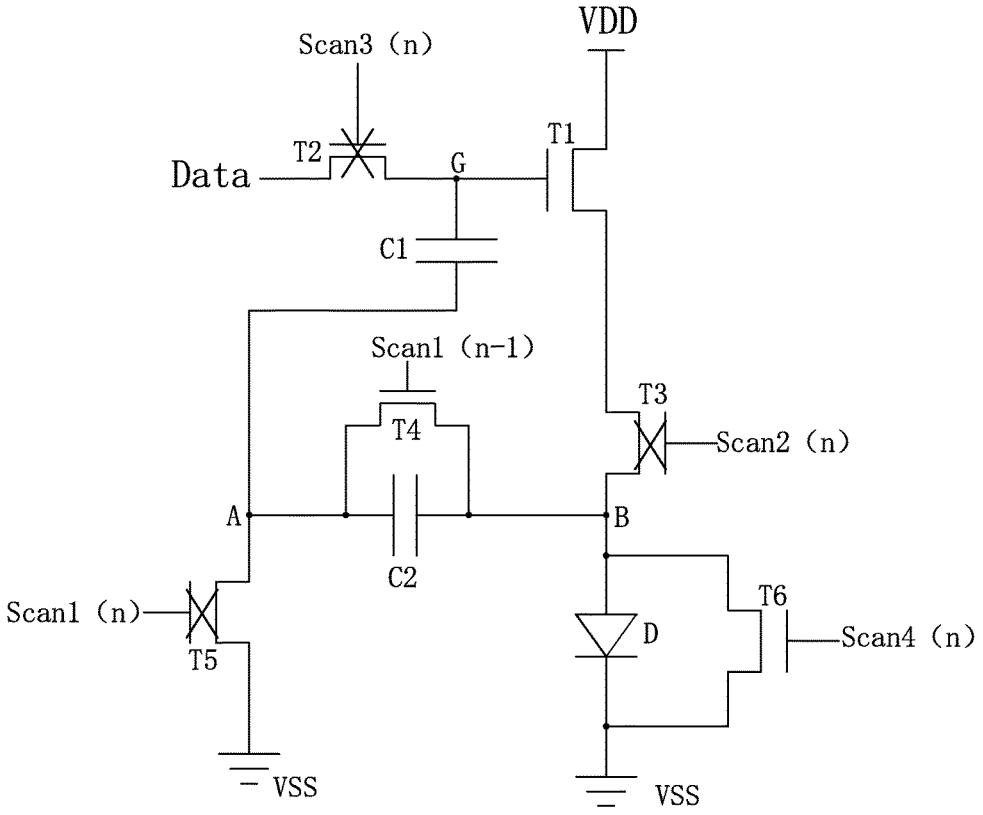
FIG. 4 is a schematic view showing Step S2 of the OLED pixel driving method provided by an embodiment of the present invention.

Refer to FIG. 2, FIG. 3 and FIG. 4. In the reset stage t1, the (n−1)-th first scan signal Scan1(*n*−1) is at high voltage, the n-th first scan signal Scan1(*n*) is at low voltage, the n-th second scan signal Scan2(*n*) is at low voltage, the n-th third scan signal Scan3(*n*) is at low voltage, the n-th fourth scan signal Scan4(*n*) is at high voltage, and the data signal Data is at low voltage; the second TFT T2, the third TFT T3, and the fifth TFT T5 are all cut-off; the fourth TFT T4 is turned on so that the two ends of the second capacitor C2 are shorted and the voltage difference of the two ends of the second capacitor C2 is 0 to achieve the reset of the second capacitor C2; the sixth TFT T6 is turned on so that the anode and the cathode of the OLED D are shorted and the voltage difference of the anode and the cathode of the OLED D is 0 to achieve the reset of the OLED D. Because the (n−1)-th first scan signal Scan1(*n*−1) is generated before the n-th first scan signal Scan1(*n*), the n-th fourth scan signal Scan4(*n*) and the (n−1)-th first scan signal Scan1(*n*−1) are synchronized within the reset stage t1. Hence, before the n-th first scan signal Scan1(*n*) arrives, the reset of the second capacitor C2 and the reset of OLED D are both completed.

Figure 5:
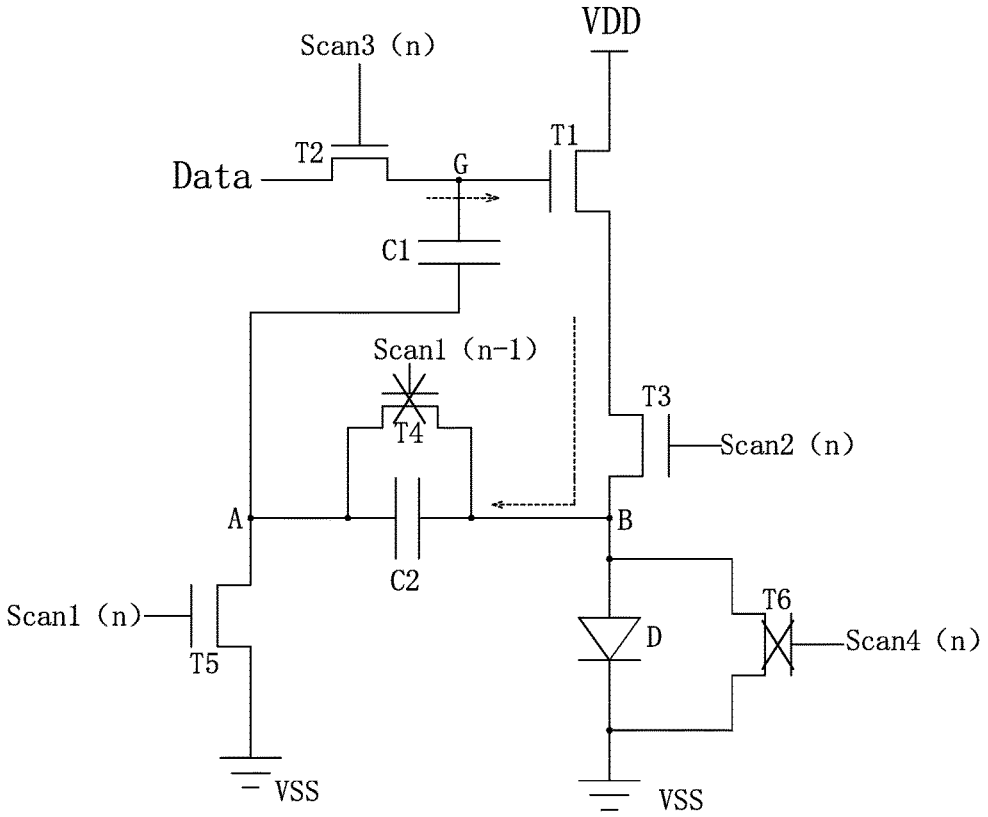
FIG. 5 is a schematic view showing Step S3 of the OLED pixel driving method provided by an embodiment of the present invention.

Refer to FIG. 2, FIG. 3 and FIG. 5. In the threshold voltage storage stage t2, the (n−1)-th first scan signal Scan1(*n*−1) is at low voltage, the n-th first scan signal Scan1(*n*) is at high voltage, the n-th second scan signal Scan2(*n*) is at high voltage, the n-th third scan signal Scan3(*n*) is at high voltage, the n-th fourth scan signal Scan4(*n*) is at low voltage, and the data signal Data is at a first high voltage $V1_D$; the fourth TFT T4 and the sixth TFT T6 are cut-off; the second TFT T2, the first TFT t1, the third TFT T3, and the fifth TFT T5 are all turned on, and the first high voltage $V1_D$ provided by the data signal Data reaches the first node G and charges the second capacitor C2 through the first TFT T1 and the third TFT T3 until voltage difference $V_{BA}$ between the two ends of the second capacitor C2, i.e., the third node B and the second node A, reaches $V_{BA}=V1_D-V_{th}$, wherein $V1_D$ is the first high voltage provided by the data signal data, $V_{th}$ is threshold voltage of the first TFT T1.

Figure 6:
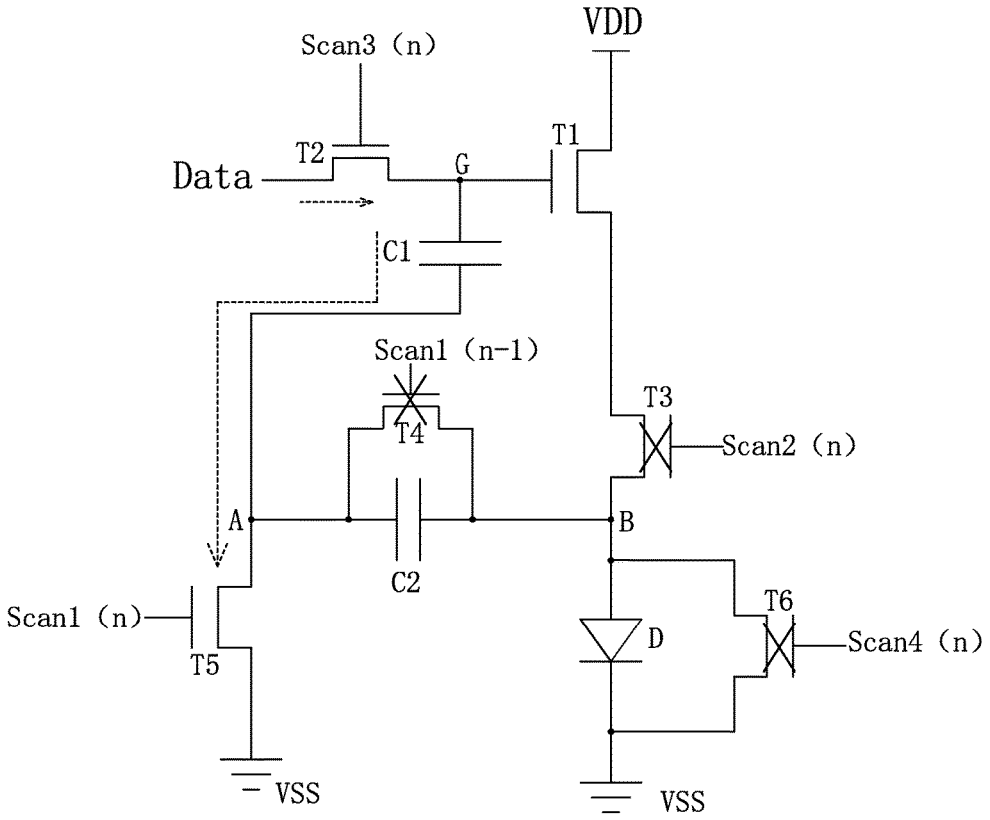
FIG. 6 is a schematic view showing Step S4 of the OLED pixel driving method provided by an embodiment of the present invention.

Refer to FIG. 2, FIG. 3 and FIG. 6. In the data writing stage t3, the (n−1)-th first scan signal Scan1(*n*−1) is at low voltage, the n-th first scan signal Scan1(*n*) is at high voltage, the n-th second scan signal Scan2(*n*) is at low voltage, the n-th third scan signal Scan3(*n*) is at high voltage, the n-th fourth scan signal Scan4(*n*) is at low voltage, and the data signal Data is at a second high voltage $V2_D$ higher than the first high voltage $V1_D$; the third TFT T3, the fourth TFT T4, and the sixth TFT T6 are cut-off; the second TFT T2, the first TFT T1, and the fifth TFT T5 are turned on, and second high voltage $V2_D$ of the data signal Data reaches the first node G and charges the first capacitor C1 so that voltage difference $V_{GA}$ between the first node G and the second node A is equal to $V_{GA}=V2_D$.

Figure 7:
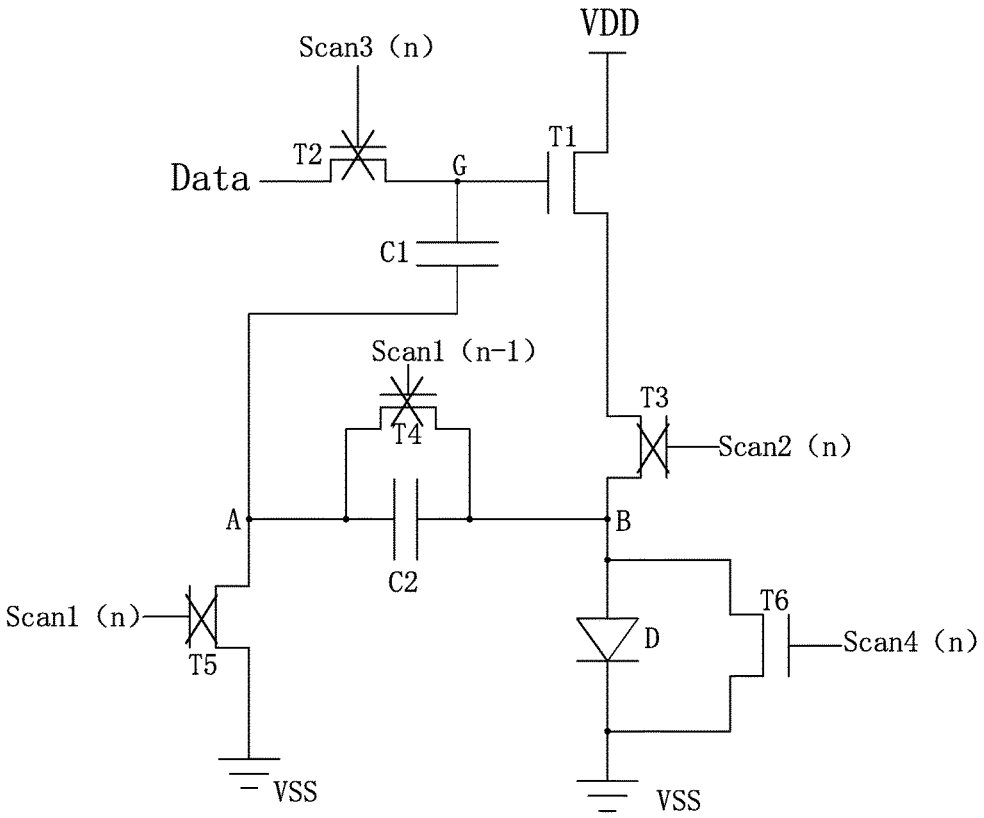
FIG. 7 is a schematic view showing Step S5 of the OLED pixel driving method provided by an embodiment of the present invention.

Refer to FIG. 2, FIG. 3 and FIG. 7. In the capacitor cascading stage t4, the (n−1)-th first scan signal Scan1(*n*−1) is at low voltage, the n-th first scan signal Scan1(*n*) is at low voltage, the n-th second scan signal Scan2(*n*) is at low voltage, the n-th third scan signal Scan3(*n*) is at low voltage, the n-th fourth scan signal Scan4(*n*) is at high voltage, and the data signal Data is at low voltage; the second TFT T2, the third TFT T3, the fourth TFT T4, and the fifth TFT T5 are cut-off; the sixth TFT T6 is turned on, the first capacitor C1 and the second capacitor C2 are cascaded so that voltage difference $V_{SB}$ between the first node G and the third node B becomes:

$$V_{GB}=V2_D-(V1_D-V_{th})=V2_D-V1_D+V_{th},$$

In the capacitor cascading stage t4, because the sixth TFT T6 shorts the anode and the cathode of the OLED D, the OLED D does not emit light.

Figure 8:
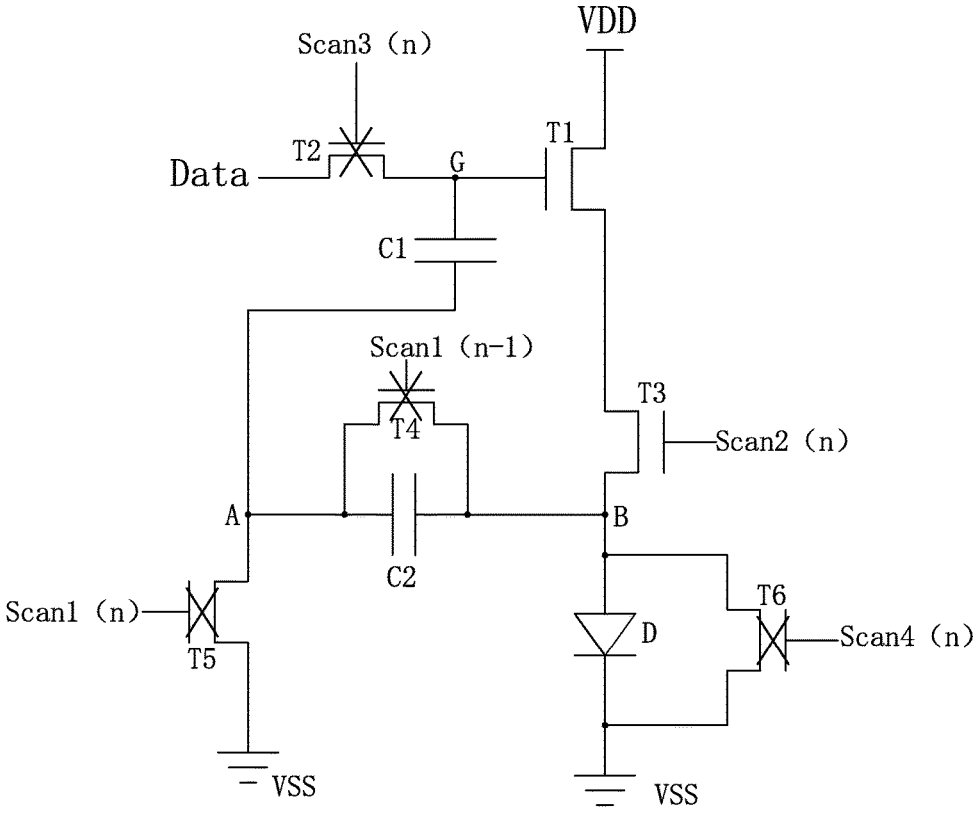
FIG. 8 is a schematic view showing Step S6 of the OLED pixel driving method provided by an embodiment of the present invention.

Refer to FIG. 2, FIG. 3 and FIG. 8. In the display lighting stage t5, the (n−1)-th first scan signal Scan1(*n*−1) is at low voltage, the n-th first scan signal Scan1(*n*) is at low voltage, the n-th second scan signal Scan2(*n*) is at high voltage, the n-th third scan signal Scan3(*n*) is at low voltage, the n-th fourth scan signal Scan4(*n*) is at low voltage, and the data signal Data is at low voltage; the second TFT T2, the fourth TFT T4, the fifth TFT T5, and the sixth TFT T6 are cut-off, the first TFT T1 and the third TFT T3 are turned on; under the storage effect of the first capacitor C1 and the second capacitor C2, the voltage difference $V_{GB}$ between the first node G and the third node B, i.e., the voltage difference Vgs between the gate and the source of the first TFT T1 stays at:

$$V_{GB}=Vgs=V2_D-V1_D+V_{th};$$

And the OLED D emits light.

Based on the equation to compute the current $I_{OLED}$ flowing through the OLED D:

$$I_{OLED}=K\times(Vgs-V_{th})^2=K\times(V2_D-V1_D+V_{th}-V_{th})^2=K\times(V2_D-V1_D)^2$$

Wherein K is the intrinsic conductive factor of the driving TFT, i.e., the first TFT T1. As shown, the current flowing through the OLED D is independent of the threshold voltage $V_{th}$ of the driving TFT T1, i.e., the first TFT T1. As such, the present invention eliminates the impact of the threshold voltage $V_{th}$ of the driving TFT on the OLED D, achieves uniform display and improves the OLED image quality.

Refer to FIGS. 4-8. The present invention also provides an OLED pixel driving method, which comprises the following steps:

Step S1: providing an OLED pixel driving circuit of a 6T2C structure as shown in FIG. 2; the details of the OLED pixel driving circuit will not be repeated.

Specifically, the first TFT T1, the second TFT T2, the third TFT T3, the fourth TFT T4, the fifth TFT T5, and the sixth TFT T6 are all low temperature polysilicon (LTPS) TFTs, oxide semiconductor TFTs, or amorphous silicon (a-Si) TFTs. The (n−1)-th first scan signal Scan1(*n*−1), the n-th first scan signal Scan1(*n*), the n-th second scan signal Scan2(*n*), the n-th third scan signal Scan3(*n*), the n-th fourth scan signal Scan4(*n*), and the data signal Data are all provided by an external timing controller.

Step S2: referring to FIG. 3 and FIG. 4, entering reset stage t1.

The (n−1)-th first scan signal Scan1(*n*−1) provides high voltage, the n-th first scan signal Scan1(*n*) provides low voltage, the n-th second scan signal Scan2(*n*) provides low voltage, the n-th third scan signal Scan3(*n*) provides low voltage, the n-th fourth scan signal Scan4(*n*) provides high voltage, and the data signal Data provides low voltage.

The second TFT T2, the third TFT T3, and the fifth TFT T5 are all cut-off; the fourth TFT T4 is turned on so that the two ends of the second capacitor C2 are shorted and the voltage difference of the two ends of the second capacitor C2 is 0 to achieve the reset of the second capacitor C2; the sixth TFT T6 is turned on so that the anode and the cathode of the OLED D are shorted and the voltage difference of the anode and the cathode of the OLED D is 0 to achieve the reset of the OLED D.

Step S3: referring to FIG. 3 and FIG. 5, entering threshold voltage storage stage t2.

The (n−1)-th first scan signal Scan1(*n*−1) becomes low voltage, the n-th first scan signal Scan1(*n*) becomes high voltage, the n-th second scan signal Scan2(*n*) becomes high voltage, the n-th third scan signal Scan3(*n*) becomes high voltage, the n-th fourth scan signal Scan4(*n*) becomes low voltage, and the data signal Data becomes a first high voltage.

The fourth TFT T4 and the sixth TFT T6 are cut-off; the second TFT T2, the first TFT t1, the third TFT T3, and the fifth TFT T5 are all turned on, and the first high voltage $V1_D$ provided by the data signal Data reaches the first node G and charges the second capacitor C2 through the first TFT T1 and the third TFT T3 until voltage difference $V_{BA}$ between the third node B and the second node A reaches $V_{BA}=V1_D-V_{th}$, wherein $V1_D$ is the first high voltage provided by the data signal data, $V_{th}$ is threshold voltage of the first TFT T1.

Step S4: referring to FIG. 3 and FIG. 6, entering data writing stage t3.

The (n−1)-th first scan signal Scan1(*n*−1) maintains at low voltage, the n-th first scan signal Scan1(*n*) maintains at high voltage, the n-th second scan signal Scan2(*n*) becomes low voltage, the n-th third scan signal Scan3(*n*) maintains at high voltage, the n-th fourth scan signal Scan4(*n*) maintains at low voltage.

The third TFT T3, the fourth TFT T4, and the sixth TFT T6 are cut-off; the second TFT T2, the first TFT T1, and the fifth TFT T5 are turned on, and second high voltage $V2_D$ of the data signal Data reaches the first node G and charges the first capacitor C1 so that voltage difference $V_{GA}$ between the first node G and the second node A is equal to $V_{GA}=V2_D$.

Step S5: referring to FIG. 3 and FIG. 7, entering capacitor cascading stage t4.

The (n−1)-th first scan signal Scan1(*n*−1) maintains at low voltage, the n-th first scan signal Scan1(*n*) becomes low voltage, the n-th second scan signal Scan2(*n*) maintains at low voltage, the n-th third scan signal Scan3(*n*) becomes low voltage, the n-th fourth scan signal Scan4(*n*) becomes high voltage, and the data signal Data becomes low voltage.

The second TFT T2, the third TFT T3, the fourth TFT T4, and the fifth TFT T5 are cut-off; the sixth TFT T6 is turned on, the first capacitor C1 and the second capacitor C2 are cascaded so that voltage difference $V_{GB}$ between the first node G and the third node B becomes:

$$V_{GB}=V2_D-(V1_D-V_{th})=V2_D-V1_D+V_{th};$$

In the capacitor cascading stage t4, because the sixth TFT T6 shorts the anode and the cathode of the OLED D, the OLED D does not emit light.

Step S6: referring to FIG. 3 and FIG. 8, entering display lighting stage t5.

The (n−1)-th first scan signal Scan1($n$−1) maintains at low voltage, the n-th first scan signal Scan1($n$) maintains at low voltage, the n-th second scan signal Scan2($n$) becomes high voltage, the n-th third scan signal Scan3($n$) maintains at low voltage, the n-th fourth scan signal Scan4($n$) becomes low voltage, and the data signal Data provides low voltage.

the second TFT T2, the fourth TFT T4, the fifth TFT T5, and the sixth TFT T6 are cut-off, the first TFT T1 and the third TFT T3 are turned on; under the storage effect of the first capacitor C1 and the second capacitor C2, the voltage difference $V_{GB}$ between the first node G and the third node B, i.e., the voltage difference Vgs between the gate and the source of the first TFT T1 stays at:

$$V_{GB}=Vgs=V2_D-V1_D+V_{th};$$

And the OLED D emits light.

Based on the equation to compute the current $I_{OLED}$ flowing through the OLED D:

$$I_{OLED}=K\times(Vgs-V_{th})^2=K\times(V2_D-V1_D+V_{th}-V_{th})^2=K\times(V2_D-V1_D)^2$$

Wherein K is the intrinsic conductive factor of the driving TFT, i.e., the first TFT T1. As shown, the current flowing through the OLED D is independent of the threshold voltage $V_{th}$ of the driving TFT T1, i.e., the first TFT T1. As such, the present invention eliminates the impact of the threshold voltage $V_{th}$ of the driving TFT on the OLED D, achieves uniform display and improves the OLED image quality.

In summary, the present invention provides an OLED pixel driving circuit and pixel driving method, adopting a 6T2C structure driving circuit, an (n−1)th first scan signal, an n-th first scan signal, an n-th second scan signal, an n-th third scan signal and an n-th fourth scan signal are combined with the data signal to correspond to a reset stage, a threshold voltage storage stage, a data writing stage, a capacitor cascading stage, and a display lighting stage respectively so that the current flowing through the OLED is independent of the threshold voltage of driving TFT, i.e., the threshold voltage of the driving TFT is compensated and the impact of the threshold voltage of driving TFT on the OLED is eliminated so as to make the display brightness of the OLED panel more uniform and improve the display quality of the OLED panel.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. An organic light-emitting diode (OLED) pixel driving circuit, comprising: a first thin film transistor (TFT), a second TFT, a third TFT, a fourth TFT, a fifth TFT, a sixth TFT, a first capacitor, a second capacitor, and an OLED;

the first TFT having a gate connected to a first node, a drain connected to a positive voltage power source, and a source connected to a drain of the third TFT; the first TFT being a driving TFT;

for a positive integer n>1, the second TFT having a gate connected to an n-th third scan signal corresponding to a row to which the pixel driving circuit belonging, a source connected to a data signal, and a drain connected to the first node;

the third TFT having a gate connected to an n-th second scan signal corresponding to a row to which the pixel driving circuit belonging, a drain connected to the source of the first TFT, and a source connected to a third node;

the fourth TFT having a gate connected to an (n−1)-th first scan signal corresponding to a row above the row to which the pixel driving circuit belonging, a source connected to a second node and one end of the second capacitor, and a drain connected to the third node and the other end of the second capacitor;

the fifth TFT having a gate connected to an n-th first scan signal corresponding to a row to which the pixel driving circuit belonging, a source connected to the second node, and a drain connected to a negative voltage power source;

the sixth TFT having a gate connected to an n-th fourth scan signal corresponding to a row to which the pixel driving circuit belonging, a source connected to the third node, and a drain connected to the negative voltage power source;

the first capacitor having one end connected to the first node and the other end connected to the second node;

the second capacitor having one end connected to the second node and the other end connected to the third node;

the OLED having an anode connected to the third node, and a cathode connected to the negative voltage power source.

2. The OLED pixel driving circuit as claimed in claim 1, wherein the first TFT, the second TFT, the third TFT, the fourth TFT, the fifth TFT, and the sixth TFT are all low temperature polysilicon (LTPS) TFTs, oxide semiconductor TFTs, or amorphous silicon (a-Si) TFTs.

3. The OLED pixel driving circuit as claimed in claim 1, wherein the (n−1)-th first scan signal, the n-th first scan signal, the n-th second scan signal, the n-th third scan signal, the n-th fourth scan signal, and the data signal are all provided by an external timing controller.

4. The OLED pixel driving circuit as claimed in claim 1, wherein the (n−1)-th first scan signal, the n-th first scan signal, the n-th second scan signal, the n-th third scan signal, the n-th fourth scan signal, and the data signal are combined to correspond to a reset stage, a threshold voltage storage stage, a data writing stage, a capacitor cascading stage, and a display lighting stage, respectively.

5. The OLED pixel driving circuit as claimed in claim 4, wherein in the reset stage, the (n−1)-th first scan signal is at high voltage, the n-th first scan signal is at low voltage, the n-th second scan signal is at low voltage, the n-th third scan signal is at low voltage, the n-th fourth scan signal is at high voltage, and the data signal is at low voltage;

in the threshold voltage storage stage, the (n−1)-th first scan signal is at low voltage, the n-th first scan signal is at high voltage, the n-th second scan signal is at high voltage, the n-th third scan signal is at high voltage, the n-th fourth scan signal is at low voltage, and the data signal is at a first high voltage;

in the data writing stage, the (n−1)-th first scan signal is at low voltage, the n-th first scan signal is at high voltage, the n-th second scan signal is at low voltage, the n-th third scan signal is at high voltage, the n-th fourth scan signal is at low voltage, and the data signal is at a second high voltage higher than the first high voltage;

in the capacitor cascading stage, the (n−1)-th first scan signal is at low voltage, the n-th first scan signal is at low voltage, the n-th second scan signal is at low voltage, the n-th third scan signal is at low voltage, the n-th fourth scan signal is at high voltage, and the data signal is at low voltage;

in the display lighting stage, the (n−1)-th first scan signal is at low voltage, the n-th first scan signal is at low voltage, the n-th second scan signal is at high voltage, the n-th third scan signal is at low voltage, the n-th fourth scan signal is at low voltage, and the data signal is at low voltage.

6. An organic light-emitting diode (OLED) pixel driving method, comprising the following steps:

Step S1: providing an OLED pixel driving circuit;

The OLED pixel driving circuit comprising: pixel driving circuit, comprising: a first thin film transistor (TFT), a second TFT, a third TFT, a fourth TFT, a fifth TFT, a sixth TFT, a first capacitor, a second capacitor, and an OLED;

the first TFT having a gate connected to a first node, a drain connected to a positive voltage power source, and a source connected to a drain of the third TFT; the first TFT being a driving TFT;

for a positive integer n>1, the second TFT having a gate connected to an n-th third scan signal corresponding to a row to which the pixel driving circuit belonging, a source connected to a data signal, and a drain connected to the first node;

the third TFT having a gate connected to an n-th second scan signal corresponding to a row to which the pixel driving circuit belonging, a drain connected to the source of the first TFT, and a source connected to a third node;

the fourth TFT having a gate connected to an (n−1)-th first scan signal corresponding to a row above the row to which the pixel driving circuit belonging, a source connected to a second node and one end of the second capacitor, and a drain connected to the third node and the other end of the second capacitor;

the fifth TFT having a gate connected to an n-th first scan signal corresponding to a row to which the pixel driving circuit belonging, a source connected to the second node, and a drain connected to a negative voltage power source;

the sixth TFT having a gate connected to an n-th fourth scan signal corresponding to a row to which the pixel driving circuit belonging, a source connected to the third node, and a drain connected to the negative voltage power source;

the first capacitor having one end connected to the first node and the other end connected to the second node;

the second capacitor having one end connected to the second node and the other end connected to the third node;

the OLED having an anode connected to the third node, and a cathode connected to the negative voltage power source;

Step S2: entering reset stage;

the (n−1)-th first scan signal providing high voltage, the n-th first scan signal providing low voltage, the n-th second scan signal providing low voltage, the n-th third scan signal providing low voltage, the n-th fourth scan signal providing high voltage, and the data signal providing low voltage; the second TFT, the third TFT, and the fifth TFT all being cut-off; the fourth TFT turned on to perform reset on the second capacitor; the sixth TFT turned on to perform reset on the OLED;

Step S3: entering threshold voltage storage stage;

the (n−1)-th first scan signal becoming low voltage, the n-th first scan signal becoming high voltage, the n-th second scan signal becoming high voltage, the n-th third scan signal becoming high voltage, the n-th fourth scan signal becoming low voltage, and the data signal becoming a first high voltage; the fourth TFT and the sixth TFT being cut-off; the second TFT, the first TFT, the third TFT, and the fifth TFT all being turned on, and the data signal providing the first high voltage to the first node and charging the second capacitor until voltage difference $V_{BA}$ between the third node and the second node reaching $V_{BA}=V\mathbf{1}_D-V_{th}$, wherein $V\mathbf{1}_D$ being the first high voltage provided by the data signal, $V_{th}$ being threshold voltage of the first TFT;

Step S4: entering data writing stage;

the (n−1)-th first scan signal maintaining at low voltage, the n-th first scan signal maintaining at high voltage, the n-th second scan signal becoming low voltage, the n-th third scan signal maintaining at high voltage, the n-th fourth scan signal maintaining at low voltage; the third TFT, the fourth TFT, and the sixth TFT being cut-off; the second TFT, the first TFT, and the fifth TFT being turned on, and the data signal providing to the first node a second high voltage higher than the first high voltage and charging the first capacitor so that voltage difference $V_{GA}$ between the first node and the second node equal to $V_{GA}=V\mathbf{2}_D$, wherein $V\mathbf{2}_D$ being the second high voltage provided by the data signal;

Step S5: entering capacitor cascading stage;

the (n−1)-th first scan signal maintaining at low voltage, the n-th first scan signal becoming low voltage, the n-th second scan signal maintaining at low voltage, the n-th third scan signal becoming low voltage, the n-th fourth scan signal becoming high voltage, and the data signal becoming low voltage; the second TFT, the third TFT, the fourth TFT, and the fifth TFT being cut-off; the sixth TFT being turned on, the first capacitor and the second capacitor being cascaded so that voltage difference $V_{GB}$ between the first node and the third node becoming $V_{GB}=V\mathbf{2}_D-V\mathbf{1}_D+V_{th}$;

Step S6: entering display lighting stage;

the (n−1)-th first scan signal maintaining at low voltage, the n-th first scan signal maintaining at low voltage, the n-th second scan signal becoming high voltage, the n-th third scan signal maintaining at low voltage, the n-th fourth scan signal becoming low voltage, and the data signal providing low voltage; the second TFT, the fourth TFT, the fifth TFT, and the sixth TFT being cut-off, the first TFT and the third TFT being turned on, the OLED emitting light, and current flowing through the OLED being independent of the threshold voltage of the driving TFT.

7. The OLED pixel driving method as claimed in claim 6, wherein the first TFT, the second TFT, the third TFT, the fourth TFT, the fifth TFT, and the sixth TFT are all low temperature polysilicon (LTPS) TFTs, oxide semiconductor TFTs, or amorphous silicon (a-Si) TFTs.

8. The OLED pixel driving method as claimed in claim 6, wherein the (n−1)-th first scan signal, the n-th first scan signal, the n-th second scan signal, the n-th third scan signal, the n-th fourth scan signal, and the data signal are all provided by an external timing controller.

9. An organic light-emitting diode (OLED) pixel driving circuit, comprising: a first thin film transistor (TFT), a second TFT, a third TFT, a fourth TFT, a fifth TFT, a sixth TFT, a first capacitor, a second capacitor, and an OLED;

the first TFT having a gate connected to a first node, a drain connected to a positive voltage power source, and a source connected to a drain of the third TFT; the first TFT being a driving TFT;

for a positive integer n>1, the second TFT having a gate connected to an n-th third scan signal corresponding to a row to which the pixel driving circuit belonging, a source connected to a data signal, and a drain connected to the first node;

the third TFT having a gate connected to an n-th second scan signal corresponding to a row to which the pixel driving circuit belonging, a drain connected to the source of the first TFT, and a source connected to a third node;

the fourth TFT having a gate connected to an (n−1)-th first scan signal corresponding to a row above the row to which the pixel driving circuit belonging, a source connected to a second node and one end of the second capacitor, and a drain connected to the third node and the other end of the second capacitor;

the fifth TFT having a gate connected to an n-th first scan signal corresponding to a row to which the pixel driving circuit belonging, a source connected to the second node, and a drain connected to a negative voltage power source;

the sixth TFT having a gate connected to an n-th fourth scan signal corresponding to a row to which the pixel driving circuit belonging, a source connected to the third node, and a drain connected to the negative voltage power source;

the first capacitor having one end connected to the first node and the other end connected to the second node;

the second capacitor having one end connected to the second node and the other end connected to the third node;

the OLED having an anode connected to the third node, and a cathode connected to the negative voltage power source;

wherein the first TFT, the second TFT, the third TFT, the fourth TFT, the fifth TFT, and the sixth TFT being all low temperature polysilicon (LTPS) TFTs, oxide semiconductor TFTs, or amorphous silicon (a-Si) TFTs;

wherein the (n−1)-th first scan signal, the n-th first scan signal, the n-th second scan signal, the n-th third scan signal, the n-th fourth scan signal, and the data signal being all provided by an external timing controller;

wherein the (n−1)-th first scan signal, the n-th first scan signal, the n-th second scan signal, the n-th third scan signal, the n-th fourth scan signal, and the data signal being combined to correspond to a reset stage, a threshold voltage storage stage, a data writing stage, a capacitor cascading stage, and a display lighting stage, respectively;

wherein in the reset stage, the (n−1)-th first scan signal being at high voltage, the n-th first scan signal being at low voltage, the n-th second scan signal being at low voltage, the n-th third scan signal being at low voltage, the n-th fourth scan signal being at high voltage, and the data signal being at low voltage;

in the threshold voltage storage stage, the (n−1)-th first scan signal being at low voltage, the n-th first scan signal being at high voltage, the n-th second scan signal being at high voltage, the n-th third scan signal being at high voltage, the n-th fourth scan signal being at low voltage, and the data signal being at a first high voltage;

in the data writing stage, the (n−1)-th first scan signal being at low voltage, the n-th first scan signal being at high voltage, the n-th second scan signal being at low voltage, the n-th third scan signal being at high voltage, the n-th fourth scan signal being at low voltage, and the data signal being at a second high voltage higher than the first high voltage;

in the capacitor cascading stage, the (n−1)-th first scan signal being at low voltage, the n-th first scan signal being at low voltage, the n-th second scan signal being at low voltage, the n-th third scan signal being at low voltage, the n-th fourth scan signal being at high voltage, and the data signal being at low voltage;

in the display lighting stage, the (n−1)-th first scan signal being at low voltage, the n-th first scan signal being at low voltage, the n-th second scan signal being at high voltage, the n-th third scan signal being at low voltage, the n-th fourth scan signal being at low voltage, and the data signal being at low voltage.

* * * * *